US011805951B2

(12) United States Patent
Louis

(10) Patent No.: US 11,805,951 B2
(45) Date of Patent: Nov. 7, 2023

(54) FOAM DISPENSERS HAVING TURBINE AIR/LIQUID DISPLACEMENT PUMP COMBINATION

(71) Applicant: GOJO Industries, Inc., Akron, OH (US)

(72) Inventor: Jeffrey S. Louis, Akron, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 17/676,282

(22) Filed: Feb. 21, 2022

(65) Prior Publication Data

US 2022/0265094 A1 Aug. 25, 2022

Related U.S. Application Data

(60) Provisional application No. 63/151,847, filed on Feb. 22, 2021.

(51) Int. Cl.

| | |
|---|---|
| ***A47K 5/14*** | (2006.01) |
| ***A47K 5/12*** | (2006.01) |
| ***B05B 7/00*** | (2006.01) |
| ***B05B 11/00*** | (2023.01) |
| ***B05B 11/10*** | (2023.01) |

(52) U.S. Cl.

CPC ..... *A47K 5/14* (2013.01); *A47K 5/1217* (2013.01); *B05B 7/0037* (2013.01); *B05B 11/1087* (2023.01)

(58) Field of Classification Search

CPC ..... A47K 5/14; A47K 5/1217; A47K 5/1208; A47K 5/16; B05B 7/0037; B05B 11/3087; B05B 11/007; B05B 11/3032; B05B 11/3052; B05B 11/3067; B05B 12/122; B05B 7/00; B05B 7/0018; B05B 7/005;

(Continued)

(56) References Cited

U.S. PATENT DOCUMENTS 2,105,202 A * 1/1938 Root ..... G01F 11/084 141/24
3,151,778 A * 10/1964 Olney ..... F04B 53/1002 222/134

(Continued)

FOREIGN PATENT DOCUMENTS

WO WO-2015074274 A1 * 5/2015 ..... A47K 5/1202

OTHER PUBLICATIONS

International Search Report and Written Opinion from PCT/US2022/017129 dated May 17, 2022.

*Primary Examiner* — Donnell A Long
(74) *Attorney, Agent, or Firm* — Calfee, Halter & Griswold LLP

(57) ABSTRACT

Exemplary embodiments of energy efficient foam pumps and dispensers are disclosed herein. An exemplary foam dispenser included a housing, a reservoir for holding a foamable liquid, a motor, a motor shaft, and a turbine air pump. The turbine air pump is connected to the motor shaft. A cam is also attached to the motor shaft and is used for driving a liquid pump. Liquid from the liquid pump and air from the turbine air pump are mixed in a mixing chamber and dispensed through an outlet nozzle. The touch-free foam dispenser further includes a sensor for sensing an object, circuitry for receiving a signal from the sensor indicative of an object being present and circuitry for energizing the motor to dispense fluid in the form of a foam.

20 Claims, 4 Drawing Sheets

(58) Field of Classification Search
CPC ..... B05B 7/0062; B05B 7/0416; F04B 9/042; F04B 13/02; F04B 17/03; F04B 23/025; F04B 23/04; F04B 43/04; F04D 13/12; F04D 17/16; F04D 25/16; A45D 27/10; A45D 27/12
See application file for complete search history.

(56) References Cited

U.S. PATENT DOCUMENTS

| | | | | |
|---|---|---|---|---|
| 7,128,541 | B2 * | 10/2006 | Kach | F04B 43/02 417/440 |
| 7,611,030 | B2 * | 11/2009 | Reynolds | A47K 5/1208 222/25 |
| 8,485,395 | B2 | 7/2013 | Ciavarella et al. | |
| 10,485,385 | B2 | 11/2019 | Tojek et al. | |
| 10,624,505 | B2 * | 4/2020 | Yan | A47K 5/16 |
| 2005/0133540 | A1 * | 6/2005 | Hornsby | B05B 9/007 239/332 |
| 2009/0308887 | A1 * | 12/2009 | Woo | A47K 5/1215 222/113 |
| 2009/0317270 | A1 * | 12/2009 | Reynolds | A47K 5/16 417/410.1 |
| 2011/0017778 | A1 * | 1/2011 | Kadiks | B05B 11/1087 222/325 |
| 2012/0285992 | A1 | 11/2012 | Ciavarella et al. | |
| 2016/0213203 | A1 * | 7/2016 | Pelfrey | B05B 7/2464 |
| 2017/0014004 | A1 * | 1/2017 | Bullock | A47K 5/1211 |
| 2017/0112332 | A1 * | 4/2017 | Ciavarella | F04B 43/04 |
| 2017/0135532 | A1 * | 5/2017 | Ciavarella | A47K 5/14 |

* cited by examiner

FOAM DISPENSERS HAVING TURBINE AIR/LIQUID DISPLACEMENT PUMP COMBINATION

RELATED APPLICATIONS

This application claims priority to and any benefit of U.S. Provisional Application No. 63/151,847, filed Feb. 22, 2021, the content of which is incorporated herein by reference in its entirety.

TECHNICAL FIELD

The present invention relates generally to foam dispensers and foam pumps for dispenser systems, and more particularly to foam pumps and foam dispensers having a turbine air/liquid displacement pump.

BACKGROUND OF THE INVENTION

Foam dispenser systems, such as liquid soap and sanitizer foam dispensers, provide a user with a predetermined amount of a foamed product upon actuation of the foam dispenser. The foam is created by, for example, injecting air into the liquid to create a foamy mixture of liquid and air bubbles. Foam dispensers are often powered by batteries or other limited power sources. A large portion of the power consumption of the foam dispensers is due to the foam pumps. Thus, there is a need for an energy efficient foam pump that can produce high quality foam.

SUMMARY

Exemplary embodiments of energy efficient foam pumps and dispensers are disclosed herein. An exemplary touch-free foam dispenser included a housing, a reservoir for holding a foamable liquid, a motor, a motor shaft, and a turbine air pump. The turbine air pump is connected to the motor shaft and the turbine air pump has an air outlet. A liquid pump having a liquid inlet and a liquid outlet. A cam for driving the liquid pump is included and the cam is connected to the motor shaft. A mixing chamber, a liquid inlet conduit extending from the reservoir to the liquid inlet of liquid pump, a liquid outlet conduit extending from the liquid outlet of the liquid pump to the mixing chamber, an air outlet conduit extending from the air outlet of the turbine air pump to the mixing chamber and an outlet nozzle located downstream of the mixing chamber are also included. The touch-free foam dispenser further includes a sensor for sensing an object, circuitry for receiving a signal from the sensor indicative of an object being present and circuitry for energizing the motor to dispense fluid in the form of a foam.

Another exemplary foam dispenser includes a housing, a reservoir for holding a foamable liquid, a motor; a turbine air pump, a liquid air pump and a cam. The turbine air pump and the cam are connected to the motor shaft. The cam drives the liquid pump. Fluid from the reservoir flows to the liquid pump through a liquid inlet conduit and from the liquid pump to a mixing chamber via a liquid outlet conduit. Air flows from the turbine air pump to the mixing chamber via an air outlet conduit. An outlet nozzle is located downstream of the mixing chamber for dispensing foam.

An exemplary foam pump includes a motor, a motor shaft and a turbine air pump. The turbine air pump is connected to the motor shaft and the turbine air pump having an air outlet. A liquid pump having a liquid inlet and a liquid outlet is also included. A cam connected to the motor shaft for driving the liquid pump, a mixing chamber and an outlet nozzle are also included. Liquid flows into the liquid pump through a liquid inlet conduit and out of the liquid pump to the mixing chamber through a liquid outlet conduit. Air flows out of the turbine air pump into the mixing chamber through an air outlet conduit. The mixture of air and liquid is dispensed out of the foam pump through an outlet nozzle located downstream of the mixing chamber.

DETAILED DESCRIPTION

Figure 1:
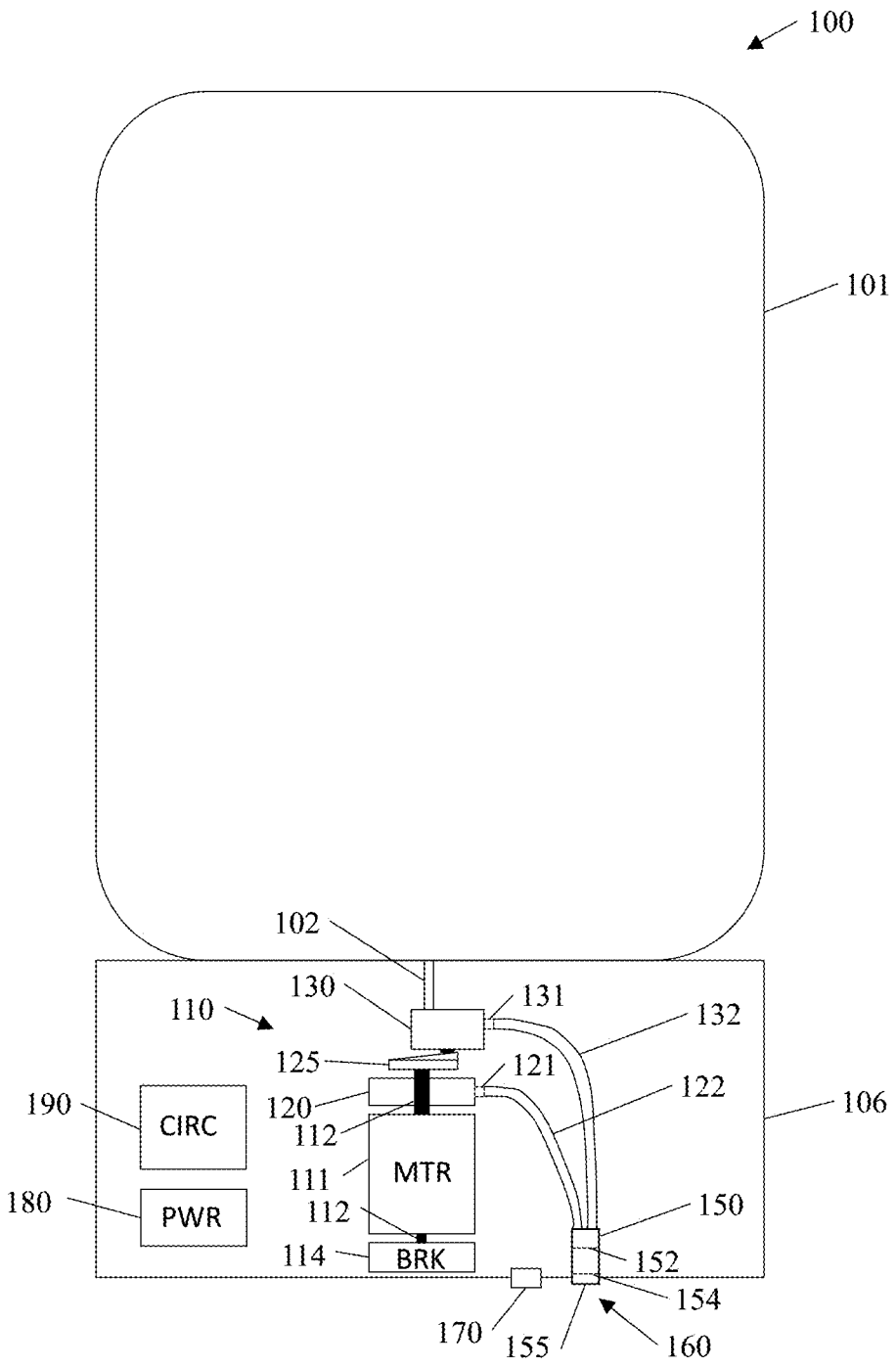
FIG. 1 is a schematic view of an exemplary energy efficient foam dispenser.

The present application discloses exemplary embodiments of foam dispensers,

FIG. 1 is a schematic view of an exemplary energy efficient foam dispenser 100. Foam dispenser 100 includes a reservoir 101. Reservoir 101 may be removable and replaceable. The reservoir 101 may be removed, for example, if it is empty and replaced with a new reservoir. These types of reservoirs may be referred to herein as a "refill unit."

Dispenser 100 also includes a housing 106. In this exemplary embodiment, housing 106 encloses some of the components described herein, and encloses a portion of the reservoir 101. In some embodiments, housing 106 may completely enclose, or substantially enclose the reservoir 101 and the other components describe herein. In some embodiments, housing 101 includes a front cover (not shown) that may be opened to reveal some or all of the components. In some embodiments, the front cover (not shown) is connected to a back plate via a hinge component and the front cover opens by swinging away from the back plate. An exemplary dispenser housing is shown and described in commonly owned U.S. Pat. No. 8,485,395, which is incorporated by reference herein in its entirety. In some embodiments, at least a portion of the reservoir 101 is exposed and the housing slides down to release the reservoir from the dispenser and to expose the pump housing and electrical components. Such an exemplary dispenser is shown and described in commonly owned U.S. Pat. No. 10,485,385, which is incorporated by reference herein in its entirety.

In this exemplary embodiment, located within housing 106, is a foam pump 110. Foam pump 110 includes a motor 111. Motor 111 has a motor shaft 112. In this exemplary embodiment, motor shaft 112 extends outward from both ends of the motor. In this exemplary embodiment, an optional brake 114 is located on one end of the motor and utilizes the motor shaft 112. Optional brake 114 may be used to stop motor rotation to control one or more of the amount of fluid dispensed, prevent or limit post dispense dripping, and/or to prevent motor overrun.

Connected to motor shaft 112 is an air turbine pump 120 and a cam 125. Liquid displacement pump 130 is positioned so that rotation of cam 125 causes liquid displacement pump 130 to pump discrete volumes of fluid.

Liquid displacement pump 130 includes a liquid inlet conduit 102, which places the liquid displacement pump 130 in fluid communication with foamable liquid located in reservoir 101. Liquid displacement pump 130 also includes a liquid outlet conduit 131, which is connected to liquid outlet conduit 132. Liquid outlet conduit 132 is connected to mixing chamber 150.

Air turbine pump 120 includes an air outlet 121. Air outlet 121 is connected to air outlet conduit 122, which is also connected to mixing chamber 150. In some embodiments, located within mixing chamber 150 is mix media. Mix media may be, for examples, one or more sponges, one or more screens, one or more baffles, or combinations thereof. In this exemplary embodiment, mix media comprises an optional first screen 152 and an optional second screen 154. Mixing chamber 150 includes a nozzle outlet 155 for dispensing foam therefrom.

In some embodiments, an optional valve (not shown) is located in liquid inlet conduit 102. In some embodiments, an optional valve (not shown) is located in liquid outlet conduit 132. Only one optional valve (not shown) is required and the optional valve (not shown) may server one or more functions. In some embodiments, the optional valve may be used to control fluid flow to liquid displacement pump 130. In such an exemplary embodiment, the supply of foamable liquid may be stopped after a selected volume of liquid has been pumped by liquid displacement pump 130. Thus, in some embodiments, when the optional valve is closed, the foam pump 110 may continue to run, but it will only pump air, because the foamable liquid supply is stopped. Such an embodiment may be useful for clearing the mixing chamber 150, mix media (e.g. screens 152, 154), and foam outlet 155.

Foam dispenser 100 includes a power source 180, control circuitry 190 and an object sensor 170. Power source 180 may be, for example, one or more batteries, one or more capacitors, one or more focused power converters, a hard wired power source, combinations thereof, or the like.

Object sensor 170 may be any type of object sensor, such as, for example, an infrared sensor, an ultrasonic sensor, an inductive sensor, a conductive sensor, or the like. Control circuitry 190 includes a processor (not shown), which may be any type of processor, such as, for example, a microprocessor or microcontroller, discrete logic, such as an application specific integrated circuit (ASIC), other programmed logic device or the like. The processor is in circuit communication with memory (now shown). The memory may be any type of memory, such as, for example, Random Access Memory (RAM); Read Only Memory (ROM); programmable read-only memory (PROM), electrically programmable read-only memory (EPROM), electrically erasable programmable read-only memory (EEPROM), flash, magnetic disk or tape, optically readable mediums including CD-ROM and DVD-ROM, or the like, or combinations of different types of memory. In some embodiments, the memory is separate from the processor, and in some embodiments, the memory resides on or within processor.

The processor is in circuit communication with object sensor 170 and any additional circuitry required for performing the operations described herein, such as, for example, turning on and off the motor 111, operating the optional brake 114, powering any indicator lights, displays, and the like.

"Circuit communication" as used herein indicates a communicative relationship between devices. Direct electrical, electromagnetic and optical connections and indirect electrical, electromagnetic and optical connections are examples of circuit communication. Two devices are in circuit communication if a signal from one is received by the other, regardless of whether the signal is modified by some other device. For example, two devices separated by one or more of the following—amplifiers, filters, transformers, optoisolators, digital or analog buffers, analog integrators, other electronic circuitry, fiber optic transceivers or satellites—are in circuit communication if a signal from one is communicated to the other, even though the signal is modified by the intermediate device(s). As another example, an electromagnetic sensor is in circuit communication with a signal if it receives electromagnetic radiation from the signal. As a final example, two devices not directly connected to each other, but both capable of interfacing with a third device, such as, for example, a CPU, are in circuit communication. Circuit communication includes providing power to one or more devices. For example, a processor may be in circuit communication with one or more batteries, indicating that the batteries provide power to the processor.

"Signal", as used herein includes, but is not limited to one or more electrical signals, power signals, analog or digital signals, one or more computer instructions, a bit or bit stream, or the like.

"Logic," synonymous with "circuit" as used herein includes, but is not limited to hardware, firmware, software and/or combinations of each to perform a function(s) or an action(s). For example, based on a desired application or needs, logic may include a software controlled microprocessor or microcontroller, discrete logic, such as an application specific integrated circuit (ASIC) or other programmed logic device. Logic may also be fully embodied as software. The circuits identified and described herein may have many different configurations to perform the desired functions.

Any values identified in the detailed description are exemplary and they are determined as needed for a particular dispenser and/or refill design. Accordingly, the inventive concepts disclosed and claimed herein are not limited to the particular values or ranges of values used to describe the embodiments disclosed herein.

During operation, when object sensor 170 detects an object, such as, for example, a hand, a signal is transmitted to circuitry 190, which causes power from power source 180 to energize motor 111. Motor 111 causes air turbine pump 120 to rotate at a high speed, e.g, 2000 to 3000 revolutions per minute "RPMs". In addition, motor 111 causes cam 125 to rotate at the same speed. Rotation of cam 125 causes upward and downward movement that actuates liquid displacement pump 131. Air from air turbine pump 120 and liquid from liquid displacement pump 130 flow into mixing chamber 150 where the air and liquid mix together and are forced through screens 152 and 154 and out of outlet 160. After a selected volume of foam is dispensed, circuitry 190 deenergizes motor 111. In some embodiments, optional brake 114 is set to stop motor 111 from spinning when the power is removed from motor 111.

In some embodiments, an optional valve (not shown) cuts off the flow of liquid to liquid displacement pump 130 prior to the motor 111 being deenergized. In that embodiment, liquid stops flowing into mixing chamber 150 shortly after the liquid supply is closed, but air continues to flow into mixing chamber 150, thereby cleaning or blowing out residual foam and/or liquid from the mixing chamber, which eliminates and/or reduces dripping from the nozzle 155.

Figure 2:
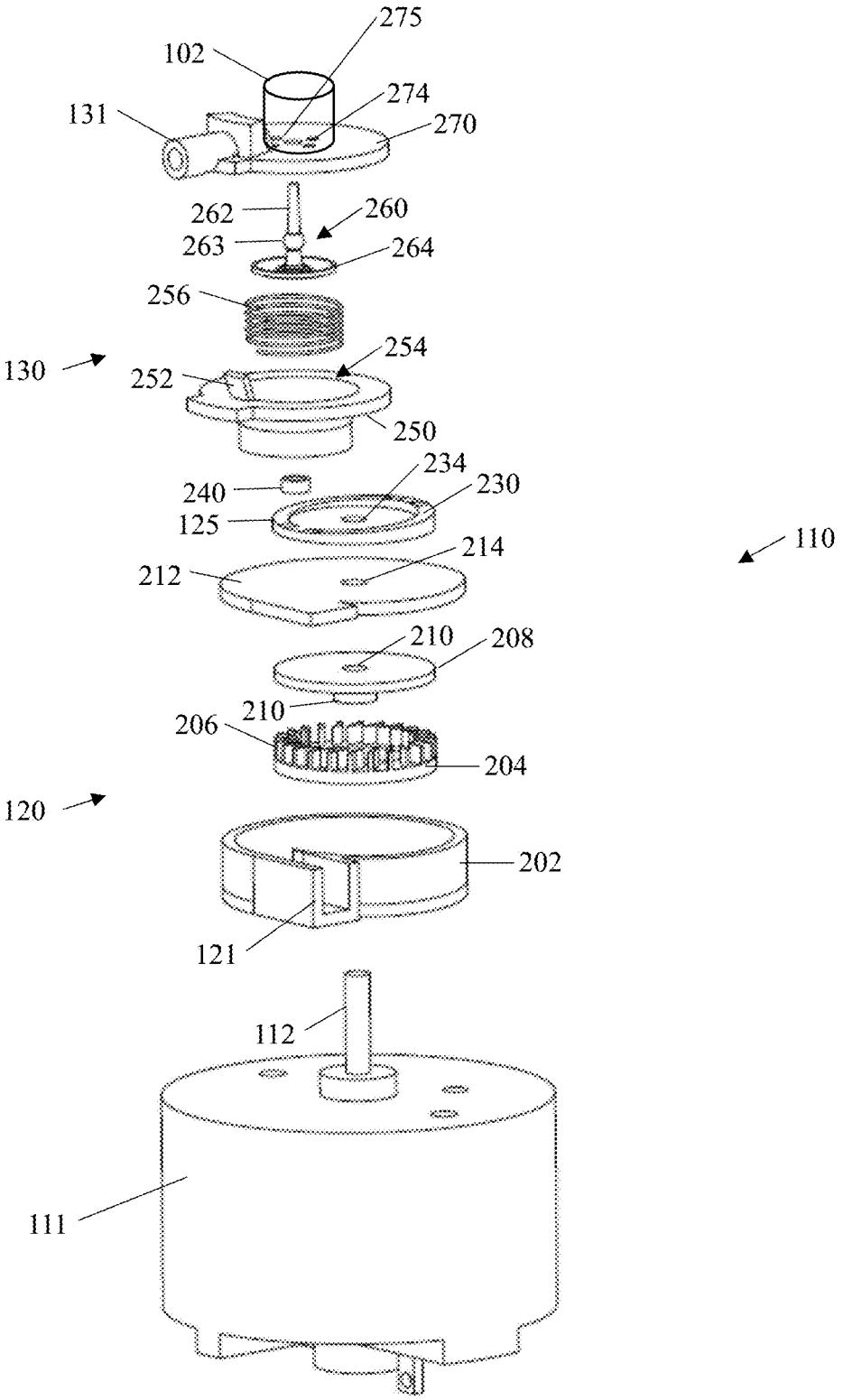
FIG. 2 is an exploded view of an exemplary combination air turbine/liquid displacement foam pump.

FIG. 2 is an exploded view of an exemplary combination air turbine/liquid displacement foam pump 110. Foam pump 110 includes a motor 111, a motor shaft 112. The turbine air pump 120 includes a volute 202, a rotor or impeller 204, an impeller cover 208 and a volute cover 212. Volute 202 fits over shaft 112 and mounts to motor 111. Rotor or impeller 204 fits over shaft 112. Rotor or impeller 204 includes a plurality of vanes 206. In this exemplary embodiment, vanes 206 have an arcuate shape. Rotor cap 208 is connected to rotor or impeller 204. Rotor cap 208 may be connected by any means, such as, for example, a welded connection. Rotor cap 208 includes a hub 210. Hub 210 is slightly smaller than motor shaft 112 and may be press fit onto motor shaft 112 to tightly secure rotor cap 208 and rotor or impeller 204 to the motor shaft. Volute cover is connected to volute by any means, such as, for example, a welded connection or a glued connection. Volute cover 214 includes an orifice 210. Orifice 210 is slightly larger than motor shaft 112, allowing motor shaft 112 to freely rotate and allowing air to flow into the volute. Volute 202 includes an opening 301 (FIG. 3) in the bottom thereof allowing motor shaft 112 to fit through. The opening is larger than motor shaft 112 allowing motor shaft 112 to freely rotate and allowing air to flow into the center of rotor or impeller 204. An air outlet 121 is in the volute housing for allowing pressurized air to flow out of volute 202. Rotation of impeller 204 causes air to be sucked into the center of the rotor or impeller 204 and forces pressurized air out of air outlet 121.

Cam 125 is alto connected to motor shaft 112 in a manner that causes cam 125 to rotate along with motor shaft 112. In some embodiments, orifice 234 is smaller than shaft 112 and cam 125 is press fit onto motor shaft 112. In some embodiments, a key (key) and/or set screw (not shown) is used to secure cam 125 to motor shaft 112. Cam 125 has a sloped surface 230 that slopes upward from a low point to a high point substantially opposite the low point and then slopes back down to the low point. In some embodiments, the slope on each side of the high point and low point is steady and gradual. In some embodiments the upward slope in the direction of cam rotation is steeper and the downward slope in the direction of rotation is gradual. In some embodiments, the upward slope in the direction of cam rotation is gradual and the downward slope is steeper or abrupt. In some embodiments, the low point is close to the high point and the downward slope is steeper or abrupt.

The liquid displacement pump portion 130 includes a pump cover 270. Pump cover 270 includes a liquid inlet 102, liquid inlet openings 274, a liquid outlet 131 and an inlet valve retention aperture 275. A liquid inlet valve 260 including a stem 262 and umbrella valve member 264 is secured to pump cover 270. Stem 262 is pulled up through valve retention aperture 275 until enlarged retention member 263 pulls through inlet valve retention aperture 275 to secure liquid inlet valve 260 to pump cover 270. Umbrella valve member 264 contacts the bottom of pump cover 270 and deflects away from pump cover 270 when there is a vacuum pressure in pump chamber 254 caused by expansion of the pump chamber 254 and seats and/or seals against pump cover 270 when pump chamber 254 is pressurized by compression. Liquid displacement pump portion 130 includes a pump diagram 250. Pump diaphragm 250 is mode of a resilient flexible material, such as, for example, silicon, and in this exemplary embodiment includes a resilient liquid outlet valve 252. A biasing member 256, such as, for example, a spring, biases pump diaphragm 250 to its expanded or uncompressed state. A bearing 240 is connected to pump diaphragm 250. Bearing 240 rides on the sloped surface of cam 125 causing the pump diaphragm 250 to compress and allows the pump diaphragm 250 to expand during rotation of cam 125 due to the forces exerted by biasing member 256 and/or the inherent resiliency in the pump diaphragm 250.

Figure 3:
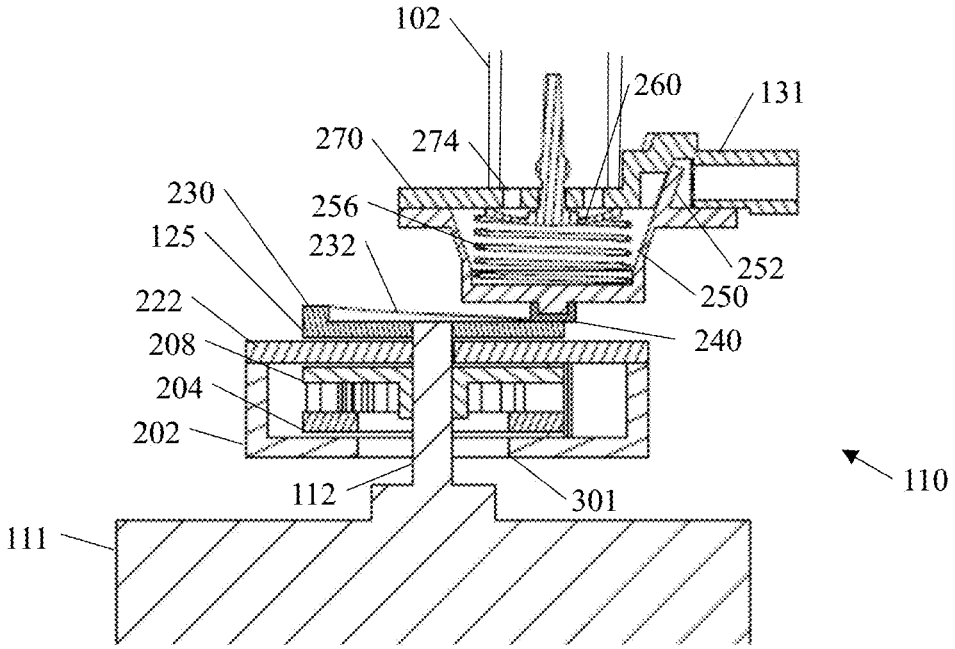
FIGS. 3 and 4 are partial cross-sections of the exemplary foam pump of FIG. 2 illustrated with the liquid displacement pump in an expanded position and in a compressed position respectively.
Figure 4:
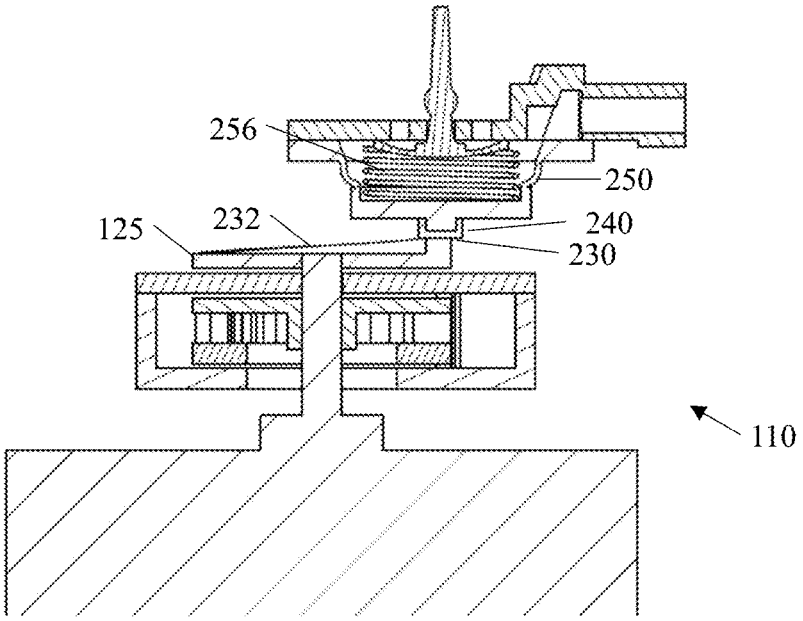

FIG. 3 is a partial cross-section of the exemplary foam pump of FIG. 2 illustrated with the liquid displacement pump in an expanded position. In this exemplary embodiment, the cam 125 is rotated so that the bearing 240 is riding against the sloped surface of the cam and is currently at the lowest point along the sloped surface, allowing pump diaphragm 250 to be fully expanded. FIG. 4 is a partial cross-section of the exemplary foam pump of FIG. 2 illustrated with the liquid displacement pump in a compressed position. In this exemplary embodiment, the cam 125 is rotated so that the bearing 240 is riding against the sloped surface of the cam and is currently at the highest point along the sloped surface, causing pump diaphragm 250 to be fully compressed.

As cam 125 rotates, pump diaphragm 250 fully compresses pumping liquid out of pump chamber 254 past one way liquid outlet valve 252 and out of liquid outlet 131. As the cam continues to rotate, pump chamber 254 expands (due to the force caused by the biasing member 256) causing liquid outlet valve 252 to close and liquid inlet valve 260 to open allowing fluid to flow through liquid inlet 102 into pump chamber 254. Each full rotation of cam 125 causes pump chamber 254 to compress and to expand to pump liquid.

Figure 5:
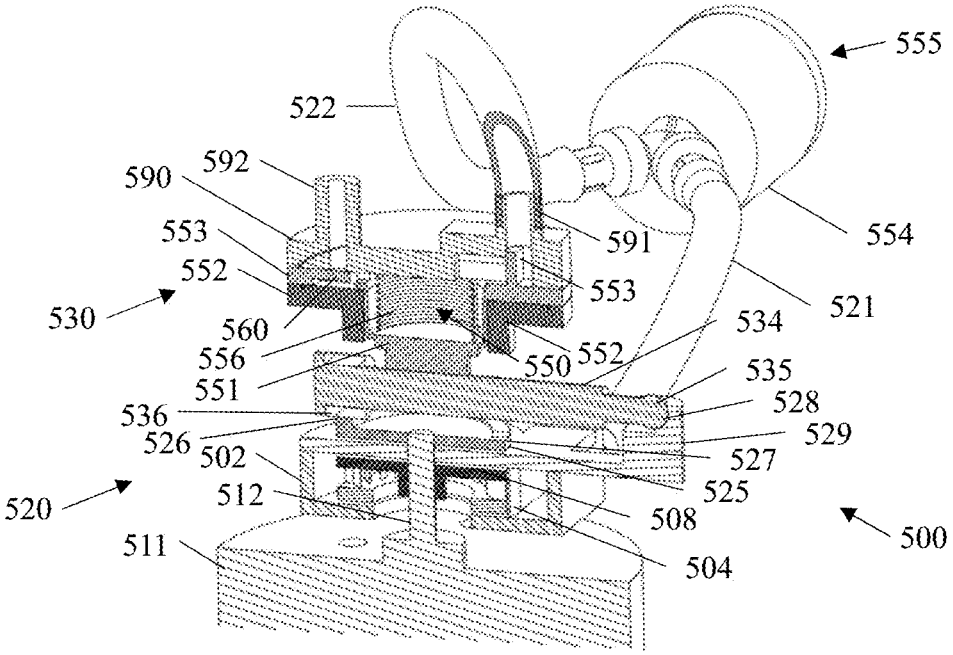
FIG. 5 is another exemplary embodiment of a combination air turbine/liquid displacement foam pump.

FIG. 5 illustrates another exemplary embodiment of a foam pump having a combination air turbine pump/liquid displacement pump 500 connected to a mixing chamber 554 having a foam outlet 555. Foam pump 500 includes a motor 511, a motor shaft 512, a turbine air pump 502, a cam 525, a pivot arm 534, and a liquid pump portion 530. Turbine air pump 502 is substantially similar to turbine air pump 120, and includes a volute 502, a rotor or impeller 504, a rotor cover 508, and a volute cover 529. Similar to the rotor described above, rotor or impeller 504 is connected to the motor shaft 512 by rotor cover 508 which is connected to rotor or impeller 504. Also connected to motor shaft is cam 525. Like cam 125, cam 525 has a sloped surface that slopes upward from a low portion 525 to a high portion 526 and back downward to the low portion 525.

Pivot arm 535 has a pivot ball 535 on one end. Pivot ball 535 is received by socket 528 in volute cover 529. Volute 502 is connected to motor 511 by a mounting bracket (not shown). Pivot arm includes a bearing surface 536 that rides on cam 525. As cam 525 rotates, pivot arm 534 moves up and down.

Liquid displacement pump portion 530 includes an upper pump housing 590, a lower pump housing 552, a molded pump diaphragm 551, and a biasing member 556. Upper pump housing includes a liquid inlet 592 and a liquid outlet. Molded pump diaphragm 551 includes a lower portion 551 a liquid inlet valve 560 and a liquid outlet valve 553. Biasing member 556, which may be, for example, a spring, biases the lower portion 551 downward to expand liquid pump chamber 550 downward. Liquid inlet valve 560 cooperates with the upper pump housing 590 to allow liquid to flow into pump chamber 550 and prevent liquid from flowing from liquid pump chamber 550 back through the liquid inlet 592. Liquid outlet valve 553 cooperates with upper pump housing 590 to allow liquid to flow from liquid pump chamber 550 out through liquid outlet 591, and prevents liquid from flowing from the liquid outlet 591 back into liquid pump chamber 550.

Connected to the air outlet (not shown) of volute 502 is air outlet conduit 521. Connected to liquid outlet 591 is liquid outlet conduit 522. Air outlet conduit 521 and liquid outlet conduit 522 connect to mixing chamber 554, which includes a foam outlet 555. Mixing chamber 554 may be located proximate foam pump 500 or may be located away from foam pump 500. Thus, foam pump 500 may be configured to produce foam proximate foam pump 500 or at a location remote from foam pump 500.

During operation, motor 511 is energized causing motor shaft 512 to rotate. Rotation of motor shaft 512 causes the impeller 504 to rotate, thereby generating a pressurized air to air outlet conduit. Rotation of motor shaft 512 also causes cam 525 to rotate. Rotation of cam 525 causes pivot arm 534 to move upward and compress liquid pump chamber 550. Compression of liquid pump chamber 550 pumps liquid into liquid outlet conduit 521 and into mixing chamber 554, where the liquid mixes with the air to form a foam that is dispensed out of the foam outlet. As cam 525 continues to rotate, liquid pump chamber 550 expands, drawing liquid into liquid pump chamber 550 from a container of foamable liquid that is connected to liquid inlet 592. As described above, an optional valve may be included in fluid communication to the liquid inlet valve 592 that may be used to stop fluid flow into the liquid pump chamber. In addition, as described above, a brake (not shown) may be included to stop the motor rotation. Cutting off fluid flow and stopping motor rotation may be useful in preventing residual fluid from dripping out to the mixing chamber and/or outlet.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

The invention claimed is:

1. A foam dispenser comprising:
a housing;
a reservoir for holding a foamable liquid;
a motor;
a motor shaft;
a turbine air pump;
wherein the turbine air pump is connected to the motor shaft;
the turbine air pump having an air outlet;
a liquid pump;
the liquid pump having an liquid inlet and a liquid outlet and a liquid pump central axis;
a cam for driving the liquid pump;
wherein the cam has a cam central axis;
wherein the cam is connected to the motor shaft;
wherein the liquid pump central axis and the came central axis extend along the same direction;
a mixing chamber;
a liquid inlet conduit extending from the reservoir to the liquid inlet of liquid pump;
a liquid outlet conduit extending from the liquid outlet of the liquid pump to the mixing chamber;
an air outlet conduit extending from the air outlet of the turbine air pump to the mixing chamber; and
an outlet nozzle located downstream of the mixing chamber.

2. The foam dispenser of claim 1 wherein the liquid pump comprises a diaphragm.

3. The foam dispenser of claim 2, wherein rotation of the cam causes the diaphragm to compress.

4. The foam dispenser of claim 2 further comprising a biasing member configured to expand the diaphragm.

5. The foam dispenser of claim 1 further comprising a bearing secured to the liquid pump, wherein the cam contacts the bearing to compress the liquid pump.

6. The foam dispenser of claim 1 further comprising a brake.

7. The foam dispenser of claim 1 wherein the turbine air pump is located between the motor and the liquid pump.

8. A foam pump comprising:
a motor;
a motor shaft;
the motor shaft having a motor shaft central axis;
a turbine air pump;
wherein the turbine air pump is connected to the motor shaft;
the turbine air pump having an air outlet;
a liquid pump;
the liquid pump having an liquid inlet and a liquid outlet and a liquid pump central axis;
wherein the motor shaft central axis extends along the same direction as the pump central axis;
a cam for driving the liquid pump;
wherein the cam is connected to the motor shaft;
a mixing chamber;
a liquid inlet conduit extending from a reservoir to the liquid inlet of liquid pump;
a liquid outlet conduit extending from the liquid outlet of the liquid pump to the mixing chamber;
an air outlet conduit extending from the air outlet of the turbine air pump to the mixing chamber; and
an outlet nozzle located downstream of the mixing chamber.

9. The foam pump of claim 8, wherein rotation of the cam causes a pump diaphragm to compress.

10. The foam pump of claim 8 further comprising a bearing secured to the liquid pump, wherein the cam contacts the bearing to compress the liquid pump.

11. The foam pump of claim 8 wherein the turbine air pump comprises a vaned rotor.

12. The foam pump of claim 8 wherein the turbine air pump comprises an impeller.

13. The foam pump of claim 8 wherein the turbine air pump comprises a volute.

14. A touch-free foam dispenser comprising:
a housing;
a reservoir for holding a foamable liquid;
a motor;
a motor shaft;
a turbine air pump;
wherein the turbine air pump is connected to the motor shaft;
the turbine air pump having an air outlet;
a liquid pump;
wherein the liquid pump compresses and expands along a linear direction;
the liquid pump having a liquid inlet and a liquid outlet;
a cam for driving the liquid pump;
wherein the cam is connected to the motor shaft;
wherein the cam drives the pump in the linear direction;
a mixing chamber;

a liquid inlet conduit extending from the reservoir to the liquid inlet of liquid pump;

a liquid outlet conduit extending from the liquid outlet of the liquid pump to the mixing chamber;

an air outlet conduit extending from the air outlet of the turbine air pump to the mixing chamber;

an outlet nozzle located downstream of the mixing chamber a sensor for sensing an object;

circuitry for receiving a signal from the sensor indicative of an object being present;

and circuitry for energizing the motor to dispense fluid in the form of a foam.

15. The touch-free foam dispenser of claim 14 further comprising a brake.

16. The touch-free foam dispenser of claim 14 further comprising circuitry for causing the brake to stop the motor.

17. The touch-free foam dispenser of claim 14 wherein the liquid pump comprises a diaphragm.

18. The touch-free foam dispenser of claim 17 further comprising a biasing member configured to expand a diaphragm.

19. The touch-free foam dispenser of claim 14 further comprising a bearing secured to the liquid pump, wherein the cam contacts the bearing to compress the liquid pump.

20. The touch-free foam dispenser of claim 14 wherein the turbine air pump is located between the motor and the liquid pump.

* * * * *